United States Patent [19]

Judge et al.

[11] Patent Number: 4,993,191

[45] Date of Patent: Feb. 19, 1991

[54] ROLLER CAM MICROFINISHING TOOLING

[75] Inventors: Edward E. Judge; Fred J. Burrows, both of Lansing, Mich.

[73] Assignee: Industrial Metal Products Corporation, Lansing, Mich.

[21] Appl. No.: 344,681

[22] Filed: Apr. 28, 1999

[51] Int. Cl.[5] ..... B24B 5/42; B24B 5/00; B24B 19/12; B24B 21/00

[52] U.S. Cl. ..... 51/154; 51/141

[58] Field of Search ..... 51/150, 154, 155, 289 R, 51/149, 281 C, 62, 145

[56] References Cited

U.S. PATENT DOCUMENTS

| | | | |
|---|---|---|---|
| Re. 31,593 | 6/1984 | Judge, Jr. | 51/62 X |
| 236,475 | 1/1881 | Ambler | 51/141 |
| 2,121,025 | 6/1938 | Egger | 51/154 |
| 2,258,733 | 10/1941 | Brackett | 51/62 |
| 2,376,531 | 5/1945 | Egger | 51/154 |
| 2,618,913 | 11/1952 | Plamcon | 51/141 |
| 2,693,669 | 11/1954 | Riedesel | 51/141 |
| 4,682,444 | 7/1987 | Judge | 51/289 R X |

*Primary Examiner*—Frederick R. Schmidt
*Assistant Examiner*—Bruce P. Watson
*Attorney, Agent, or Firm*—Harness, Dickey & Pierce

[57] ABSTRACT

A microfinishing machine and tooling particularly adapted for lobed cam surfaces such as internal combustion engine camshafts or outer irregular surfaces. The microfinishing tooling includes shoes having a pair of rollers which press abrasive coated film material against the workpiece being machined. The rollers are carried by a plate which is also free to rotate slightly. The roller elements are free to rotate and therefore wear on the tooling is minimized in response to minute motion of the microfinishing film during the microfinishing process. Furthermore, the roller elements closely follow the contours of the workpiece surface to provide a more uniform machining effect. Various configurations for the roller elements are disclosed, including a unitary roller made of a hard material and another embodiment in which the roller is coated with an elastomeric material.

4 Claims, 2 Drawing Sheets

ROLLER CAM MICROFINISHING TOOLING

BACKGROUND AND SUMMARY OF THE INVENTION

This invention is related to microfinishing tooling particularly adapted for microfinishing irregular surfaces such as cam lobes for internal combustion engine camshafts.

Numerous types of machinery components must have finely controlled surface finishes in order to perform satisfactorily. For example, surface finish control, also referred to as "microfinishing" is particularly significant in relation to the manufacturing of journal bearings and cam surfaces such as are found on internal combustion engine crankshafts, camshafts and power transmission shafts. When microfinishing surfaces which are cylindrical in shape, an insert having a surface conforming to the workpiece is used which presses an abrasive coated film against the surface as the tooling or the workpiece is rotated. The relative sliding motion of the workpiece surface along the abrasive film causes the surface finish to be improved by abrasive action. For surfaces which are not surfaces of revolution or which are rotated about an axis offset from their center such as cam surfaces, tooling capable of following the workpiece surface during roation is required. Microfinishing operations for surfaces such as the cam lobes on internal combustion engine camshafts are typically carried out using an insert made of a relatively hard but compressible material such as urethane which presses the machining film against the cam surface Such insert typically have "fingers" which are resilient to maintain the film in continuous contact with the workpiece surface. Although prior art devices for accomplishing such microfinishing of irregular surfaces like cam lobes operate generally satisfactorily, they suffer from a number of drawbacks. When using a solid insert material such as urethane, periodic indexing of the abrasive coated film needed to present a new abrasive surface for microfinishing between machining cycles causes wear of the insert. In addition, a minute amount of movement occurs between the insert and film during microfinishing causing a "scrubbing" action which wears the insert. Another disadvantage of such tooling is deformation of the tooling as it follows the contours of a cam surface as it is rotated causing uneven and non-uniform pressure to be applied to the workpiece surface.

This invention is directed toward improved microfinishing tooling particularly adapted for microfinishing irregular surfaces such as camshaft lobes. The tooling utilizes a pair of rollers which press an abrasive coated film against the workpiece during microfinishing. The rollers are free to rotate when the abrasive coated film is indexed and during microfinishing to minimize wearing of the roller surfaces. Moreover, since the rollers are made from a hard material, they are not subject to rapid wear due to the film indexing motion. The roller shoes are further provided with articulating pivots which enable the rollers to follow the contours of the cam lobe as it is rotated to provide more uniform contact pressure against the workpiece.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
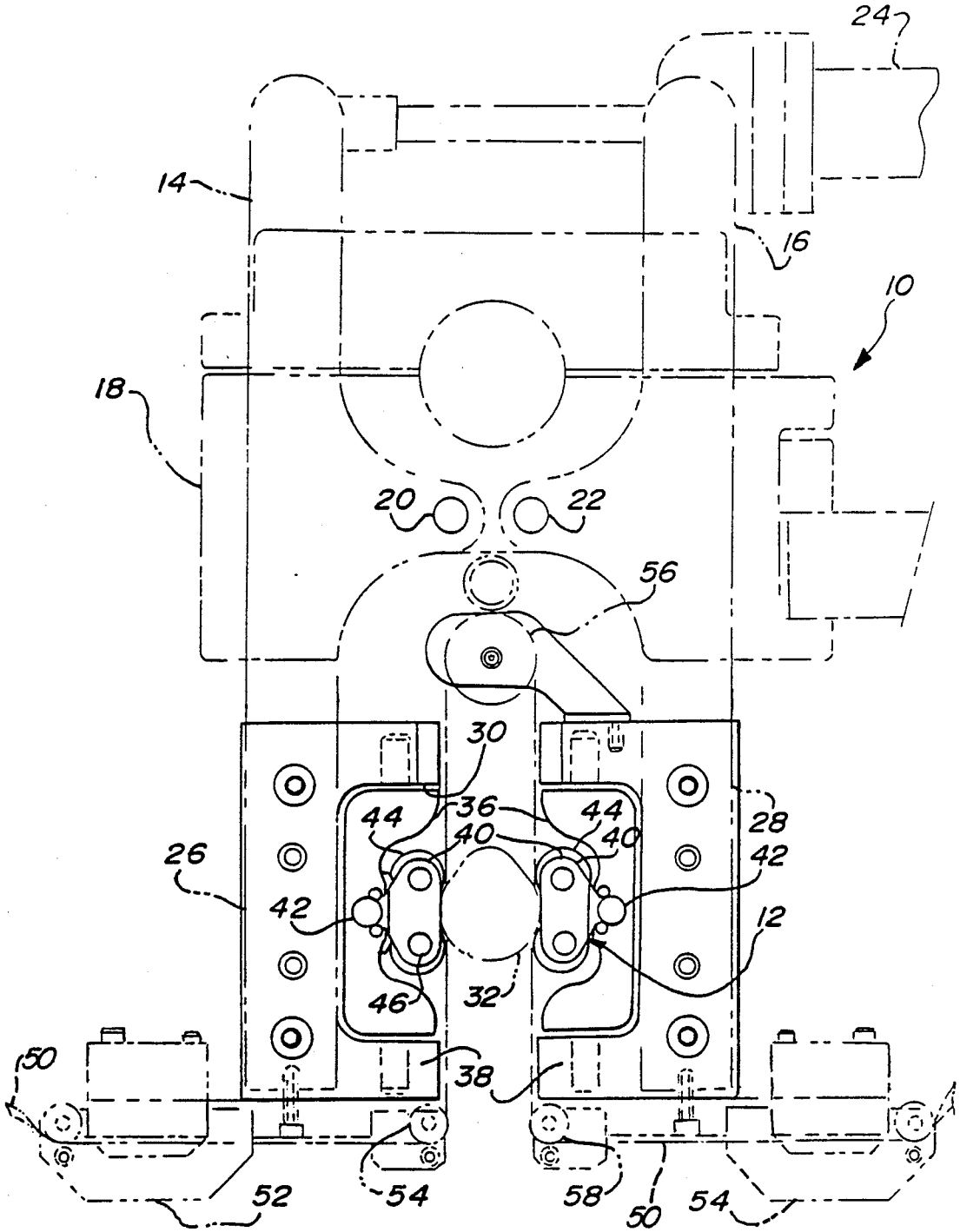
FIG. 1 is an elevational view of a microfinishing machine and tooling according to this invention showing a representative workpiece in position for machining by the device.

A microfinishing machine according to this invention is shown in FIG. 1 and is generally designated there by reference number 10. Microfinishing machine 10 is constructed in accordance with prior art techniques with the exception of microfinishing tooling 12. Machine 10 includes a pair of support arms 14 and 16 which are attached to support plate 18 by pivot pins 20 and 22, respectively. Clamping cylinder 24 is coupled to arms 14 and 16 and is actuatable to cause the arms to undergo clamping and unclamping motion. A pair of shoe hangers 26 and 28 are affixed to arms 14 and 16, respectively. Each of the hangers defines a U-shaped tool pocket 30. In operation, clamping cylinder 24 can be actuated to separate arms 14 and 16 to release a workpiece such as the cam lobe 32 shown in FIG. 1. When a new workpiece is presented, clamping cylinder 24 is again actuated to cause arms 14 and 16 to clamp against the workpiece.

Microfinishing tooling 12 will be described with particular reference to FIG. 2 Since the tooling associated with each hanger 26 and 28 are identical, only one will be described in detail. Support block 36 fits within tool pocket 30 and is supported by pivot pins 38 which enable it to rotate slightly about the axis defined by pivot pins 38. A pair of roller plates 40 are provided whch are carried by support block 36 by pin 42 which enable the roller plates 40 to pivot slightly about pin 42. A pair of rollers 44 are attached to roller plate 40 by pins 46 which enable the rollers to rotate freely.

Microfinishing machine 10 further includes means for moving abrasive coated film 50 through the machine. Tape clamps 52 and 54 are provided which clamp the tape during microfinishing to prevent movement, and also cause the tape to index between microfinishing operations on workpieces. As shown, film 50 wraps around a series of rollers 54, 56 and 58 as it passes through the machine. Film 50 is positioned between cam lobe 32 and microfinishing tooling 12.

As cam lobe 32 is rotated during microfinishing operation, roller elements 44 are urged into constant engagement with the cam lobe as it is rotated and are capable of rotating about pin 42 to follow the contours of the cam lobe. This articulation keeps the film in constant engagement with the workpiece producing a uniform machining effect.

Figure 2:
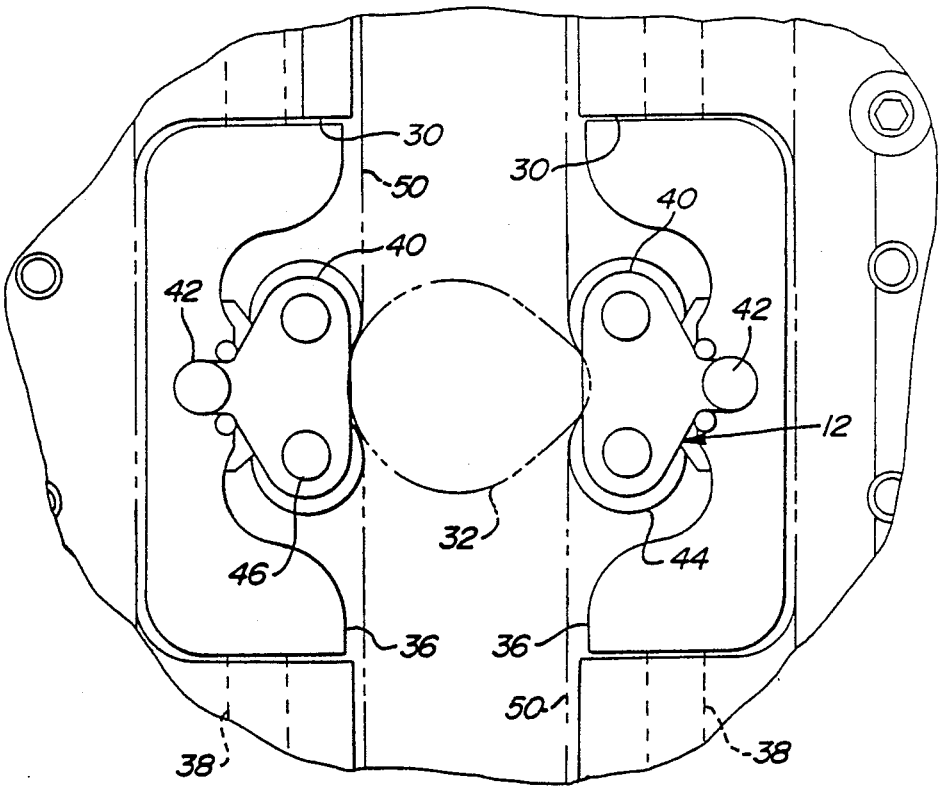
FIG. 2 is an enlarged elevational view particularly showing the roller cam tooling according to this invention.

As shown in FIG. 1, the lift portion or lobe of the cam is at the 12 o'clock position When the lobe is rotated, for example, in a clockwise direction, the lobe eventually reaches a 3 o'clock position, as shown in FIG. 2, in which the peak of the lobe is positioned between adjacent roller elements 44 of the microfinishing tooling. In this position, microfinishing film 50 is pulled slightly along roller elements 44 since the amount of the film between the two rollers changes with the shape of the portion of the lobe between adjacent roller elements. Since roller elements 44 are free to roll about pins 46, such minute changes in the length of film between the roller elements does not result in roller element wear. When using prior art microfinishing tooling in which an elastomeric tooling material is provided, such minute movement causes tooling wear due to a scrubbing action on the tooling. Indexing of the tape between actuation cycles also does not impose significant wear on roller elements 44 due to their ability to freely rotate as mentioned previously.

Figure 3:
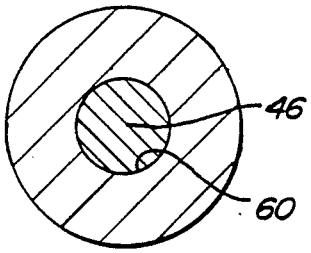
FIG. 3 is an elevational view of a roller according to a first embodiment of this invention which is made from a solid material.
Figure 4:
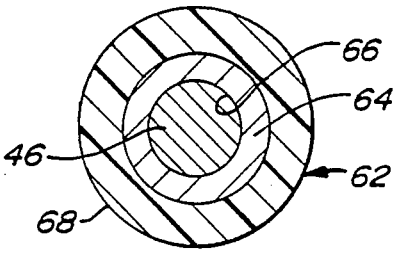
FIG. 4 is an elevational view of a roller according to a second embodiment of this invention which incorporates a solid center portion with an elastomeric coating.

FIG. 3 illustrates a first embodiment of the rollers for microfinishing tooling 12 in which the roller includes a central bore 60 which closely receives pin 46. The remainder of the roller is made from a rigid material such as steel, carbide, ceramic, etc. FIG. 4 illustrates a second embodiment of a roller element 62 which has a central bushing 64 having bore 66 which closely conforms to pin 46 and an outer covering of an elastomeric material 68 such as urethane. In some applications roller element 62 offers advantages since the elastomeric material 68 deforms sufficiently to increase the area of the microfinishing film 50 which is pressed against the workpiece. Long life for the elastomeric material 68 is provided for the reasons discussed above in which roller elements 62 are free to rotate about pins 42 and 46.

While the above description constitutes the preferred embodiments of the present invention it will be appreciated that the invention is susceptible of modification, variation and change without departing from the proper scope and fair meaning of the accompanying claims.

We claim:

1. A microfinishing tool for a microfinishing machine in which said tool presses an abrasive coated film against a workpiece cam lobe which is rotated with respect to said tool such that said film machines the cam lobe surface of said workpiece, comprising:

support means for mounting said tool to said machine, roller plate means for attachment to said support means by a pivot which permits said roller plate means to pivot with respect to said support means, and a pair of separated roller elements affixed to said roller plate means by bearing means which allows said roller elements to freely rotate, wherein said film if positioned between said workpiece cam lobe surface and said roller elements such that said roller elements directly press said film against said workpiece cam lobe surface and said pivot and said bearing means allow said roller plate means and said roller elements to closely follow the cam lobe shape of said workpiece wherein said roller elements are permitted to rotate slightly during a machining operation in which said workpiece surface is roated with respect to said tool.

2. Microfinishing tooling as set forth in claim 1 wherein said roller element is made from a metal material.

3. Microfinishing tooling as set forth in claim 1 wherein said roller is a composite structure having an elastomeric outer covering.

4. A microfinishing machine having tooling for pressing an abrasive coated film against a camshaft lobe surface as the camshaft is rotated with respect to the tooling causing the lobe surface to be machined, comprising:

a pair of microfinishing tools each having a pair of separated roller elements affixed to a roller plate for free rotation and said roller plate being mounted for pivotable motion with respect to said microfinishing machine, support means for supporting said tools to enable said tools to be clamped against said camshaft lobe surface or unclamped, guide means for said abrasive coated film for guiding said film through one of said tools between said roller elements and said camshaft lobe, and thereafter through the other of said tools between said roller elements and said camshaft lobe, whereby said tools engage said camshaft lobe at opposite sides of said lobe and upon rotation of said camshaft lobe, said tools closely follow the outer contours of said lobe.

* * * * *